US005264822A

United States Patent [19]

Vogelman et al.

[11] Patent Number: 5,264,822

[45] Date of Patent: Nov. 23, 1993

[54] SYSTEM FOR TRANSMITTING AUDIO ADVERTISING MESSAGES TO SHOPPING CARTS MOVING THROUGH SPATIALLY DEFINED TRANSMISSION ZONES ARRANGED IN A STORE

[76] Inventors: Joseph H. Vogelman, 48 Green Dr., Roslyn, N.Y. 11576; Edward R. Palombi, 80 Park Ave., New York, N.Y. 10016

[21] Appl. No.: 660,740

[22] Filed: Feb. 22, 1991

[51] Int. Cl.[5] ..... G08B 7/00

[52] U.S. Cl. ..... 340/286.01; 340/692; 340/825.36

[58] Field of Search ..... 455/344, 63, 67; 340/572, 568, 549, 540, 692, 825.36, 286.01; 186/62

[56] References Cited

U.S. PATENT DOCUMENTS

| | | | |
|---|---|---|---|
| 1,810,264 | 6/1931 | Bonitz | 40/455 |
| 2,626,995 | 1/1953 | Hodson et al. | 381/77 |
| 3,157,871 | 11/1964 | Umanoff | 340/539 |
| 3,660,762 | 5/1972 | Smith | 455/37.1 |
| 3,755,818 | 8/1973 | Greenspan | 455/53 |
| 4,071,740 | 1/1978 | Gogulski | 235/431 |
| 4,541,119 | 9/1985 | Cooper et al. | 455/57 |
| 4,670,798 | 6/1987 | Campbell et al. | 360/12 |
| 4,750,151 | 6/1988 | Baus | 364/900 |
| 4,882,724 | 11/1989 | Vela et al. | 364/401 |
| 4,888,709 | 12/1989 | Revesz | 340/825.07 |
| 4,973,952 | 11/1990 | Malec | 186/62 |

*Primary Examiner*—Jin F. Ng
*Assistant Examiner*—Christine K. Oda
*Attorney, Agent, or Firm*—Hopgood, Calimafde, Kalil, Blaustein & Judlowe

[57] ABSTRACT

A system for delivering audio advertising messages to shopping carts moving through a plurality of spatially defined transmission zones arranged in the aisles of a store. In the illustrative embodiment, a plurality of transmitters of compact construction are each attached to a shelf within the store. Each shelf transmitter has a spatially defined transmission zone of selected geometry and predetermined dimensions so as to occupy an assigned region of space within one of the aisles in the store. When any one of these transmitters detects a shopping cart residing in its spatially defined transmission zone, the transmitter transmits over its spatially defined transmission zone, a modulated signal carrying an audio message provided by a playback mechanism within the transmitter. A receiver on the detected shopping cart demodulates the received modulated carrier signal and produces an audible signal of the audio message provided by the playback mechanism in the transmitter. As a result of the present invention, the same carrier frequency can be used by each shelf transmitter throughout the store, permitting the use of identical shelf transmitters, while the construction of the shopping cart receivers is made remarkably simple and inexpensive.

11 Claims, 9 Drawing Sheets

SYSTEM FOR TRANSMITTING AUDIO ADVERTISING MESSAGES TO SHOPPING CARTS MOVING THROUGH SPATIALLY DEFINED TRANSMISSION ZONES ARRANGED IN A STORE

BACKGROUND OF THE INVENTION

1. Field of Invention

The present invention relates to apparatus for audibly advertising products to shoppers at the point-of-purchase in a store, and more particularly, to such apparatus having essentially portable components that may be simply and selectively repositioned within desired portions of the store in order to establish spatially separable zones of local advertising where desired or required.

2. Brief Description of the Prior Art

A variety of prior art systems are known for advertising products to shoppers at the point-of-purchase in a store.

For example, in U.S. Pat. No. 4,670,798 to Campbell, et al. discloses a shelf-mounted, point-of-purchase advertising system that uses ultrasonic energy to sense the presence of a person in the vicinity of an advertising display, and thereupon produces prerecorded audible messages. While capable of audibly advertising to shoppers in the store, this system suffers, however, from several significant shortcomings and drawbacks. In particular, audible messages from such a system necessarily emanate from the shelf-mounted transmitter and consequently must be of a sufficiently loud level to be audible by a shopper whose presence has been detected. When using several of these systems along a particular shopping aisle, the composite sounds of each system's message necessarily tend to interfere with adjacent advertisers, thereby creating a combination of discordant sounds.

U.S. Pat. No. 4,882,724 to Vela et al. disclose a shopper communication system which is presently realized as the Video Cart TM shoppers communication system commercially available from Videocart, Inc., of Chicago, Ill. The Vela et al. system comprises an automated in-store computer, a network of sensors mounted on the ceiling and racks throughout the store, and a plurality of cart-mounted computers each having a video display screen. The in-store computer transmits a location-triggerable video program to each cart computer which stores the video program for future access and display on its video screen. As the shoppers move their carts through the store, the sensors transmit a signal to each cart computer, thereby accessing a specific portion of the video program, and the visually advertising on the video screen, aisle specials at the point-of-purchase. While the system is capable of visually displaying brief advertising messages at the shelf location of the advertised product, the system has several significant shortcomings and drawbacks. In particular, the requirement of a network of permanently mounted sensors in the ceiling and racks renders the system unnecessarily complex, making installation both time and labor intensive. Also, in such a communication system, each shopping cart requires a computer and means for receiving, storing, and visually displaying the video program. This makes the overall system necessarily complex, equipment intensive, and prone to failure and requiring high levels of maintenance. Furthermore, this system requires the shopper's to continually look at the cart display while walking through the store aisles.

Thus, while the prior art has proposed a variety of apparatus for advertising to shoppers, at the point-of-sale in a store, there has clearly been a great need in the art for apparatus which does not suffer from the above described shortcomings and drawbacks.

Accordingly, it is a primary object of the present invention to provide essentially portable apparatus for audibly advertising products to shoppers at the point of sale in a store, in which system components can be selectively repositioned in the store so as to establish spatially-separable advertising (i.e., transmission) zones of variable dimensions were desired or required.

It is another object of the present invention to provide such apparatus in the form of an essentially portable system comprising a plurality of portable, battery-operated local transmitters adapted for selected repositioning within the store, and a cart receiver suitably attached to each shopping cart for receiving infra-red signal transmissions from local transmitters.

It is another object of the present invention to provide such a system, in which a beam of infra-red light transmitted from each local transmitter is used to establish a particular spatially defined advertising zone, and that the size and dimension of each such zone can be adjusted for spatial-multiplexing store aisle shopping space into the plurality of spatially separable advertising zones.

It is another object of the present invention to provide such a system, in which each cart receiver has a power module that can be simply recharged when a plurality of shopping carts are nested together and electrically connected to suitable power recharging apparatus.

A further object of the present invention is to provide such a system, in which each local transmitter (i) stores its advertiser's message on a end-less loop cassette tape, (ii) uses infra-red light to detect the presence of a shopping cart in its transmission zone and thereupon actuates the transmission of a message bearing optical signal, and (iii) has a rechargeable plug in power module for simply restoring the required operating power levels to each of the local transmitters.

Yet another object of the present invention is to provide advertising apparatus in the form of an essentially portable system, comprising one or more elevated or ceiling-mountable remote transmitters, plurality of shelf-mountable local transceivers in data communication with one of the remote transmitters, and one or more cart receivers which can receive audio messages from a remote transmitter, by way of a local transceiver.

Another object of the present invention is to provide such a system in which each remote transmitter receives optical message signals from a central message console and transmits such message signals to a shopping cart by way of a local transceiver.

Another object of the present invention is to provide such a system, in which each remote transmitter is detachably positionable on a selected portion of a drop ceiling or otherwise elevated platform, and comprises passive components for receiving a plurality of infra-red signals and focusing these optical signals into optical beams, each of which is directed to a particular local transceiver for reception and retransmission as an optical signal to a shopping cart receiver in its transmission zone.

Another object of the present invention is to provide such a system, in which each local transceiver comprises passive components for receiving an optical beam and producing a retransmitted optical beam in a manner to establish a spatially separable transmission zone in a store aisle that desirably avoids overlapping of adjacent transmission zones.

An even further object of the present invention is to provide such a system in which the rechargeable power supply module of each cart receiver is adapted to establish a parallel electrical connection with a plurality of shopping carts nested together, so that they can be simultaneously charged when not in use.

Another object is to provide all of the above in a system which further includes an alarm means that audibly sounds off when the shopping cart receiver is moved outside a predefined region about a store, and which is capable of sending general announcements to each shopping cart receiver from a remote location.

These and other objects of the present invention will become apparent hereinafter and in the claims.

SUMMARY OF INVENTION

According to one aspect of the present invention, advertising apparatus is provided for placement in a store and delivering audible advertising messages to a shopping cart when moved through predefined transmission zones established within the store. In general, the apparatus comprises at least one local transmitter adapted for selective placement in the store, and one or more cart receivers each adapted for attachment to a shopping cart. Each local transmitter includes an audio message storage and playback means for storing and playing back stored audio messages, and a transmitting means for transmitting a modulated carrier signal over a predefined spatially separable transmission zone. The modulated carrier signal is formed by modulating a carrier signal by an audio message provided from the audio storage and playback means. Each cart receiver includes a receiving means for receiving over each transmission zone, the modulated carrier signal and deriving therefrom an electrical audio signal representative of the audio message. The apparatus also includes a transducer means for transducing the electrical audio signal into an audible acoustical signal that is representative of the audio message provided from the audio storage and playback unit.

In the preferred embodiment, each local transmitter further includes a shopping cart detection means for enabling the transmission of the modulated carrier signal upon detection of the shopping cart in the transmission zone.

According to another aspect of the present invention, there is provided apparatus in the form of an advertising system comprising at least one remote transmitter, a plurality of local transceivers, and one or more cart receivers. Each remote transmitter includes a plurality of remote transmitting means, each for selectively transmitting a modulated carrier signal formed by modulating a carrier signal by an audio message provided from an audio message storage and playback means. Each local transceiver is adapted for placement in the store and includes a receiving means for receiving one of the transmitted modulated carrier signal, and a local transmitting means for transmitting over a predefined spatially separable transmission zone, a retransmitted signal representative of the received modulated carrier signal. Each cart receiver is adapted for attachment to a shopping cart and includes a cart receiving means and a transducer means. The cart receiving means is for receiving over each transmission zone, the respective modulated carrier signal and for deriving therefrom an electrical audio signal representative of the audio message. The transducer means is provided for transducing the electrical audio signal into an acoustical signal that is representative of the stored and played back audio message.

In one particular embodiment of this advertising system, each remote transmitter is realized using all passive components and all optical signals are delivered thereto by optical transmission cables. Similarly, each local transceiver is realized using all passive components and receives a transmitted optical signal from its designated remote transmitter, and then retransmits an appropriately shaped optical beam in its respective advertiser's transmission zone. Advantageously, each remote transmitter and local transceiver of this system does not require battery or other power sources, enhancing the overall flexibility and portability of the system.

BRIEF DESCRIPTION OF THE DRAWINGS

For a fuller understanding of the objects of the present invention, reference is made to the detailed description of the illustrative embodiments which are to be taken in connection with the accompanying drawings, wherein.

DETAILED DESCRIPTION OF THE ILLUSTRATED EMBODIMENTS

Figure 1A:
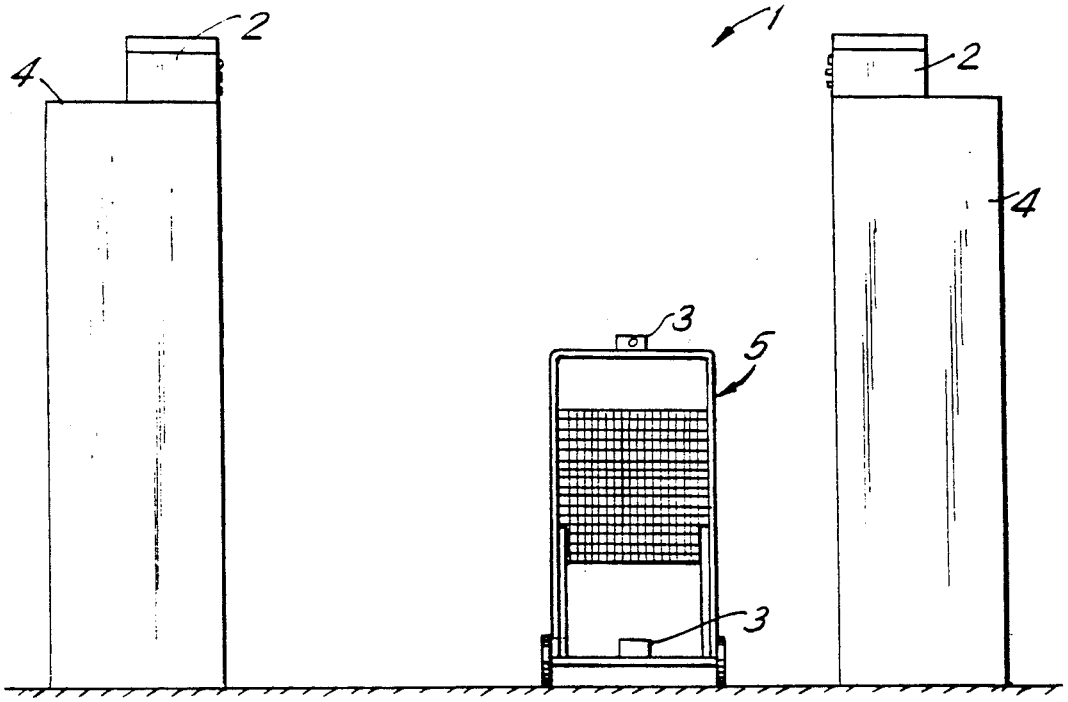
FIG. 1A is a schematic diagram illustrating, while in the cart presence detection mode, the operation of the advertising system of the first embodiment of the present invention.
Figure 5:
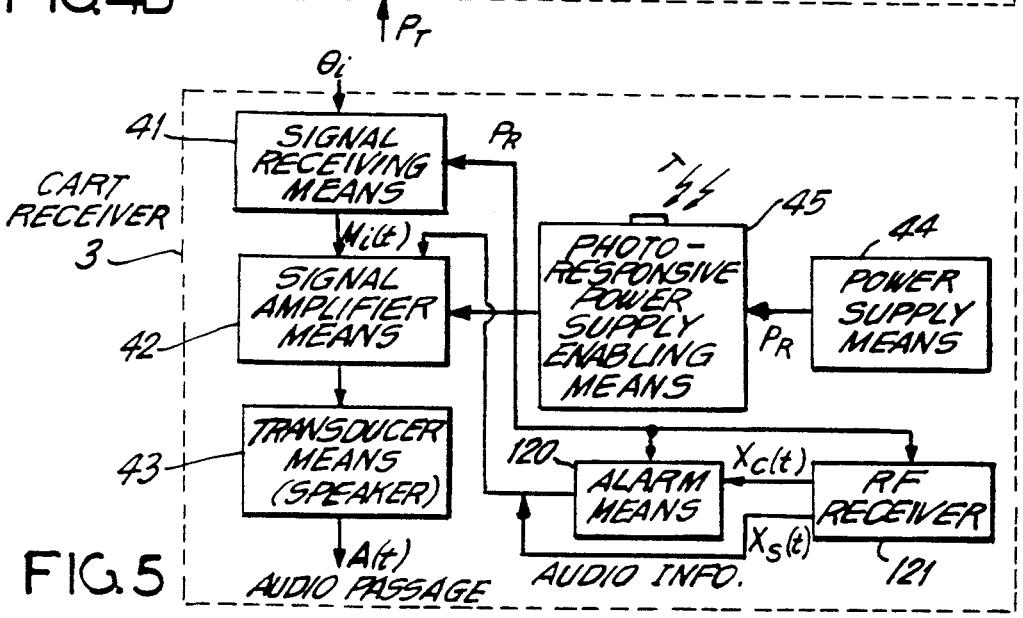
FIG. 5 is a block functional diagram of a local receiver of the first embodiment of the present invention.
Figure 5A:
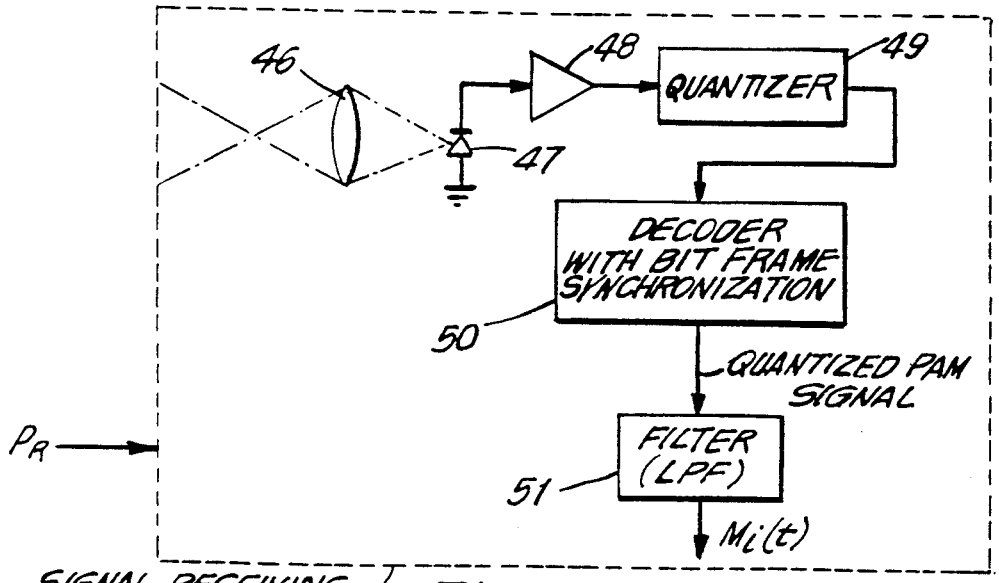
FIG. 5A is a block functional diagram of the signal receiving means of the local receiver illustrated in FIG. 5.

In FIGS. 1A, through 5A, a first embodiment of the apparatus of the present invention is shown. In this particular embodiment, the apparatus is realized as a portable point-of-sale advertising system which is adapted for placement in a store to deliver audible advertising messages to a shopping cart when moved through one of a plurality of predefined, spatially separable transmission zones, indicated by reference character $Z_i$ in FIGS. 1B and 1C.

Figure 1B:
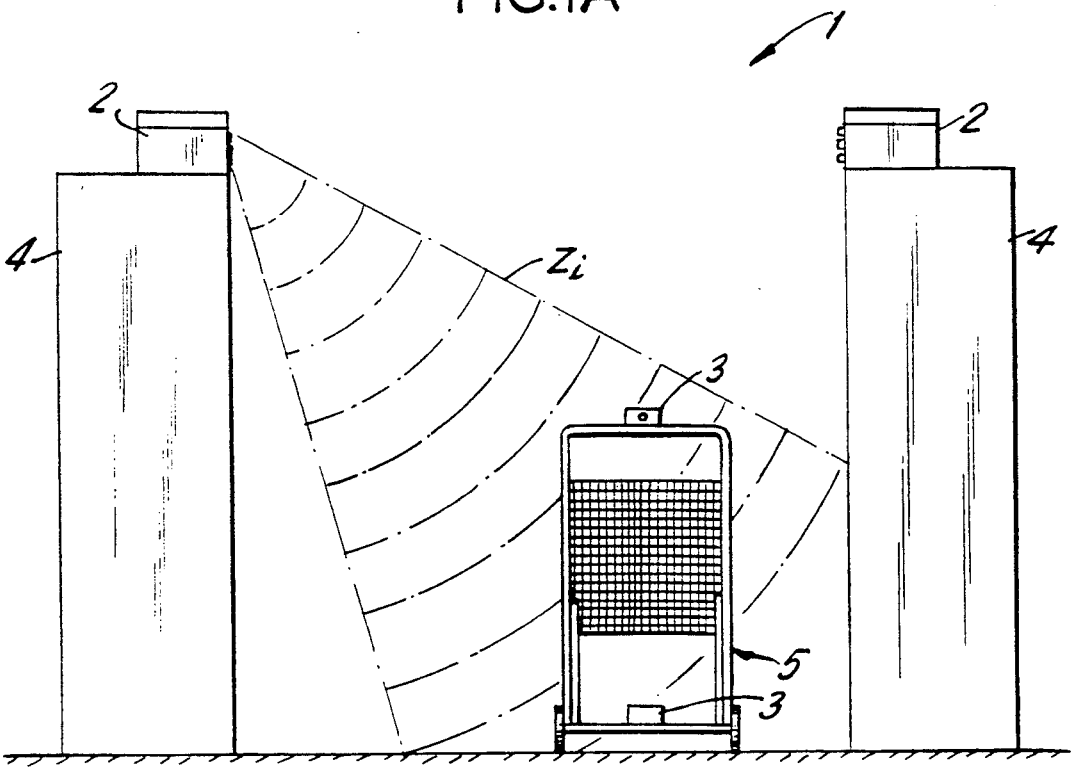
FIG. 1B is a schematic diagram illustrating, while in the message transmission mode, the operation of the advertising system of the first embodiment of the present invention.
Figure 1C:
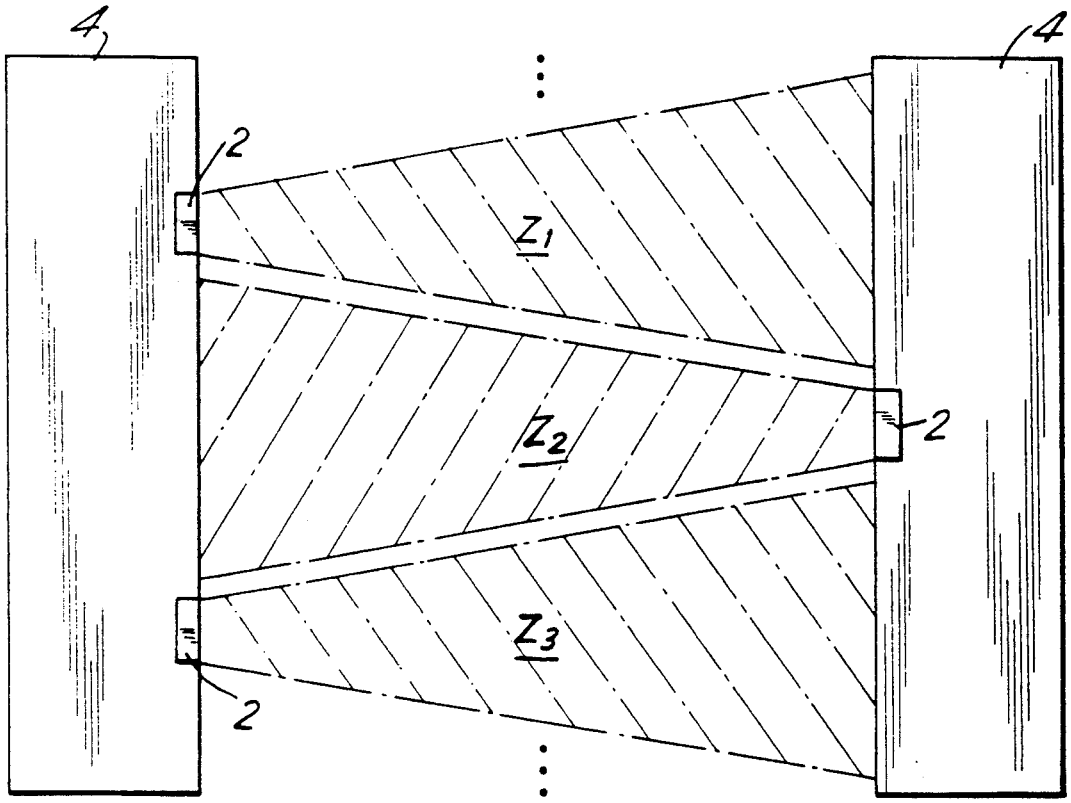
FIG. 1C is a schematic diagram illustrating from a plan view, the operation of the advertising system of FIGS. 1A and 1B.
Figure 1D:
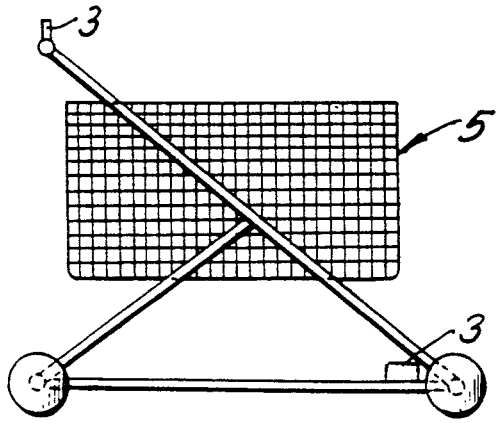
FIG. 1D is an elevated side view of a shopping cart equipped with a shopping cart receiver of the present invention.

In general, advertising system 1 comprises at least one local transmitter 2 and one or more shopping cart receivers 3, as shown in FIGS. 1A, 1B and 1D. Each local transmitter 2 is adapted for selective placement in a store, for example, on a store shelf 4 as shown in FIGS. 1A and 1B. On the other hand, each shopping cart receiver 3 is adapted for selective attachment to a conventional shopping cart 5, as shown in either FIGS. 1A, 1B, or 1D.

Figure 4:
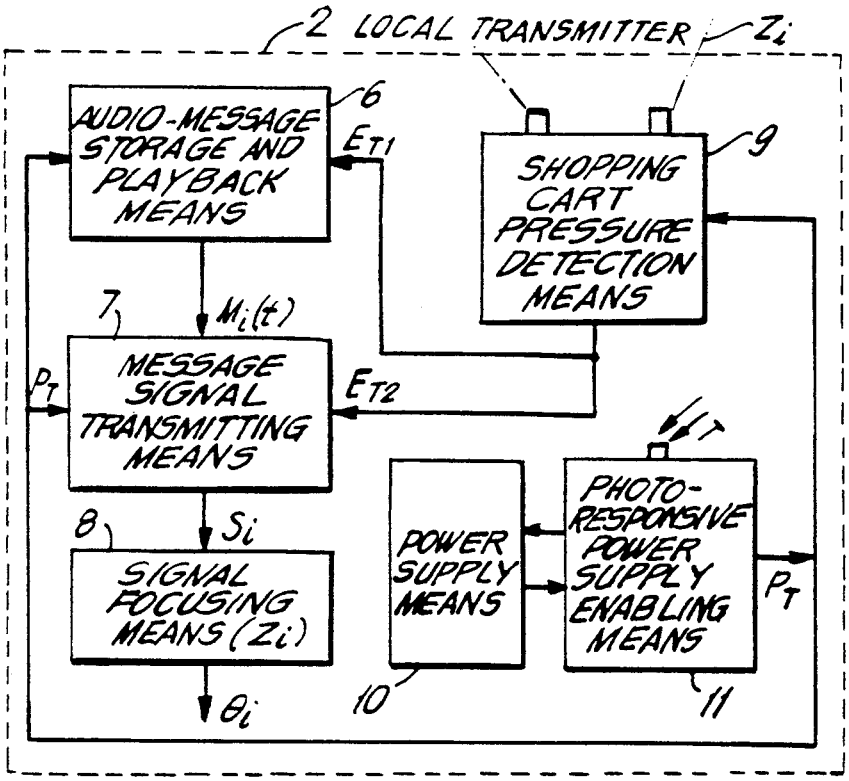
FIG. 4 is a block functional diagram of a local transmitter of the first embodiment of the present invention.

In FIG. 4, the components of local transmitter 2 of the first embodiment are illustrated. As shown, each local transmitter 2 comprises audio message storage and playback means 6 for storing and playing back stored audio messages; message signal transmitting means 7; signal focusing means 8; shopping cart presence detection means 9; power supply means 10; and photoresponsive power supply enabling means 11 for enabling the provision of power from power supply means 10 to the other components of the local transmitter.

Audio message storage and playback means 6 can be either an analog or digital information storage device provided with data access capabilities which are activated when shopping cart presence detection means 9 generates a transmission enabling signal $E_{T1}$. As illustrated, shopping cart detection means 9 generates transmission enabling signals $E_{T1}$ and $E_{T2}$ when it detects a shopping cart within a predefined transmission zone $Z_i$ formed by signal focusing means 8. While audio-message storage and playback means 6 is enabled by enabling signal $E_{T1}$, signal transmitting means 7 is enabled by enabling signal $E_{T2}$ in order to produce a digitally modulated carrier signal $S_i$. As will be described in greater detail hereinafter, digitally modulated carrier signal $S_i$ is formed by modulating a digital carrier signal by a sampled audio message signal $m_i(t)$ accessed from audio storage and playback means 6. As will be later described, the function of signal focusing means 8 is to focus the modulated carrier signal $S_i$ into an optical signal $\Theta_i$ which is suitably adapted for transmission over spatially separable transmission zone $Z_i$ of predefined dimensions.

Figure 4A:
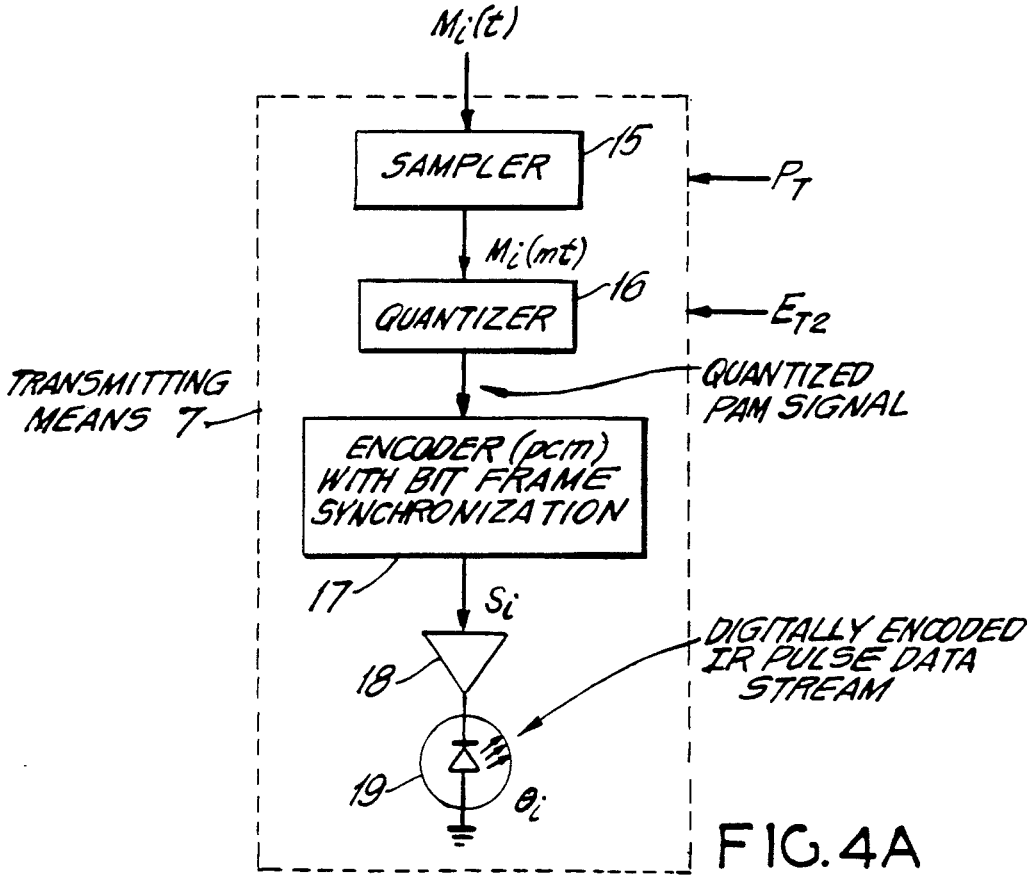
FIG. 4A is a block functional diagram of the signal transmitting means of the local receiver illustrated in FIG. 4.
Figure 4B:
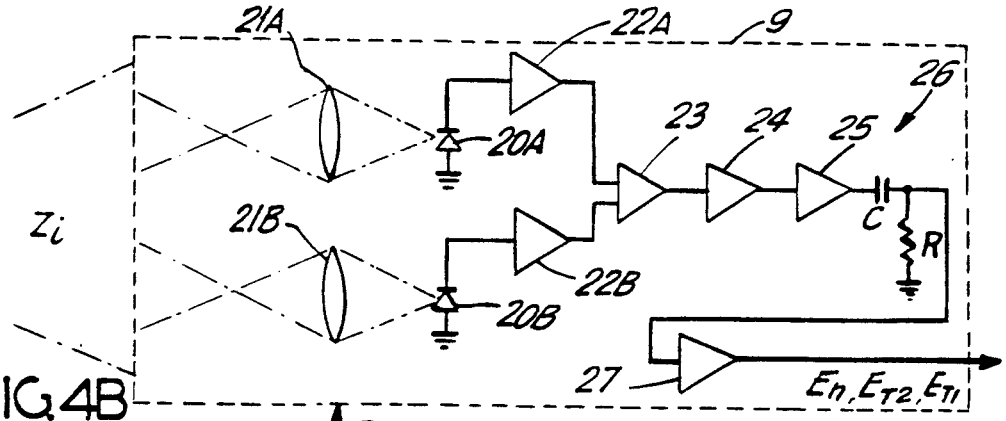
FIG. 4B is a block functional diagram of the shopping cart presence detection means of the present invention.

FIGS. 4A and 4B schematically illustrate one embodiment of local transmitter 2. The physical construction of local transmitter 2 is further illustrated in FIGS. 2 and 2A. In such an embodiment, each prerecorded audio messages $m_i(t)$ is stored in analog format on a conventional cassette tape 13, and is played back using a conventional cassette transport system provided with control and signal processing circuitry well known in the art. Analog audio message $m_i(t)$ is modulated onto a digital carrier using a conventional pulse code modulation (PCM) technique. When shopping cart detection means 9 detects the presence of a shopping cart in transmission zone $Z_i$, audio message $m_i(t)$ is accessed and converted into an electrical signal which is used to produce a digitally (PCM) encoded electrical signal $S_i$. Signal $S_i$ is then converted into an digitally encoded optical, i.e., infra-red (IR) signal $\Theta_i$, and is subsequently focused and transmitted over a predefined, spatially separable transmission zone $Z_i$, assigned to the advertiser of a particular product. Cart receiver 3 within transmission zone $Z_i$ receives the digitally encoded IR signal $\Theta_i$ and derives therefrom, an electrical message signal representative of audio message $m_i(t)$. A transducer, such as a speaker, then transduces the electrical message signal into an audible acoustical signal that is representative of the audio message $m_i(t)$ accessed from the storage and playback unit 6.

In FIG. 4A, message signal transmitting means 7 of local transmitter 2, is shown implemented using PCM technology. When realized as a circuit as shown, message signal transmitting means 7 is provided with power supply signal $P_T$ and transmitter enable signal $E_{T2}$. As discussed hereinabove, these signals are produced from power supply enabling means 11 and shopping cart detection means 9, respectively. As shown, analog message signal $m_i(t)$ is accessed from storage and playback means 6 and sampled by sampler 15 to provide a sampled sequence $m_i(mt)$. These samples are then subjected to the operation of quantization by quantizer 16 and, in essence, produces a quantized pulse amplitude modulated (PAM) signal. These quantized samples are subsequently applied to an encoder 17 which responds to each such quantized sample by generating a unique and identifiable binary pulse (or binary level) pattern. Typically, the pulse pattern will have a numerical significance which is the same as the order assigned to the quantized levels. Also, to identify which binary pulses belong to a group of bits representing a quantized sample of the analog signal, synchronization bits are added to the data stream to permit frame synchronization at cart receiver 3 in a manner known in the art.

The quantizer 16 and encoder 17 together function to accept the sampled analog signal and replaces it with a succession of code symbols, each consisting of a train of pulses in which each pulse may be interpreted as the representation of a digit in an arithmetic number system. Consequently, the signal generated from the output of encoder 17 is a digitally encoded electrical signal. This digitally encoded signal is provided to a voltage-to-current amplifier 18. The output of voltage-to-current amplifier 18 is applied to an infra-red (IR) photodiode 19 to drive the same to produce digitally encoded IR signal $\Theta_i$, which corresponds to the digitally encoded electrical signal $S_i$ output from encoder 17. Using signal focusing means shown in FIG. 2A, for example, digitally encoded IR signal $\Theta_i$ can then be shaped and focused to provide a well defined, spatially separable transmission zone $Z_i$ of selected geometry and dimensions.

In order to conserve power consumed by circuitry used in realizing local transmitter 2, shopping cart detection means 9 produces enable signals $E_{T1}$ and $E_{T2}$ only upon detecting a shopping cart in transmission zone $Z_i$. In generating enable signals $E_{T1}$ and $E_{T2}$, several approaches may be taken. Among the possible techniques which may be utilized, passive and active methods using radiant or ultrasonic energy are presently contemplated.

In FIG. 4B, a passive technique is illustrated, in which passive detection of ambient light within transmission zone $Z_i$ is performed in order to determine whether a cart receiver 3 (and thus shopping cart) is present therein. As illustrated in FIG. 4B, shopping cart detection means is realized as a passive ambient light detection circuit 9. In particular, circuit 9 comprises a pair of photodiodes 20A and 20B which sense ambient light gathered from two different parts of the transmission zone $Z_i$ in front of local transmitter $Z_i$, using focusing lenses 21A and 21B, respectively. The output signals of photodiodes 20A and 20B are converted to voltages by current-to-voltage amplifiers 22A and 22B, respectively, which are then provided as input to differential amplifier 23. The output of differential amplifier 23 is provided as input to a sample and hold amplifier 24 in order to reject 60 and 120 Hz noise. Output signal of amplifier 24 is provided as input to a logarithmic amplifier 25 to command signal swing. The output signal of logarithmic amplifier 25 is provided as input to a differentor 26 and then to a comparator 27. The output of comparator 27 provides enable signals $E_{T1}$ and $E_{T2}$, which together constitute transmission enabling signals. Typically, these enable signals will assume a logical high level (i.e., 1) when an object is detected transmission zone $Z_i$ and logical low (i.e., 0) when no object is present therein. These enable signals are typically provided to enabling inputs of electronic devices and/or circuits employed in the realization of these system components.

In order to ensure that local transmitter 2 consumes power only when conditions in the store are suitable for shopping and consumer advertising, photo-responsive power supply enabling means 11 senses and determines whether ambient lighting conditions exceed a predetermined threshold, and if so, provides power $P_T$. From power supply means 10, to other components 6, 7 and 8 of local transmitter 2, as shown in FIG. 4. Otherwise, if ambient lighting conditions are sensed as being too low, then local transmitter 2 is disempowered. In addition, photo-responsive power supply enabling means 11 can be adapted to function as a battery recharging means. In such a case, the potential energy of ambient light, can be collected, stored and used to maintain the electrical charge in the power supply means (e.g. battery) 10.

Figure 2:
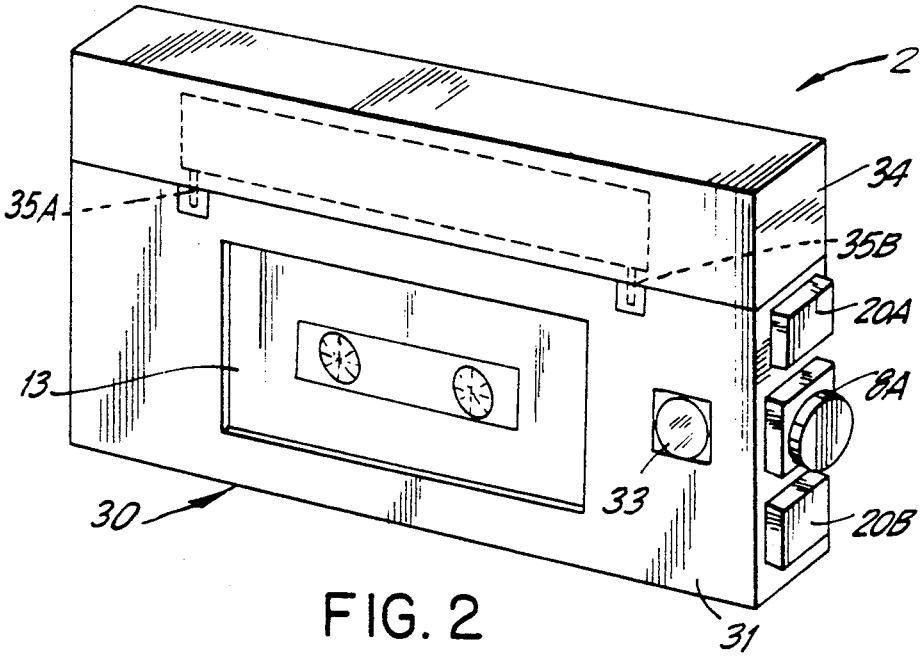
FIG. 2 is a perspective view of a local transmitter of the system of the first embodiment of the present invention.

In FIG. 2, there is shown local transmitter 2 constructed in accordance with the system illustrated in FIGS. 4A and 4B and described hereinabove. In this embodiment, local transmitter 2 comprises a housing generally indicated by reference numeral 30. The main portion 31 of the housing encloses a cassette-type audio message storage and playback system 6, transmitting means 7, signal focusing means 8A, shopping cart detection means 9, and photo-responsive power enabling means 11. As shown, photo-sensitive device 33 of power supply enabling means 11, is mounted external to housing 31, so as to be capable of sensing ambient lighting conditions, as required by power supply enabling means 11. On the other hand, axillary portion 34 of housing encloses a rechargeable-type battery power supply module which is operably associatable with photo-responsive power enabling means 11 and other system components, by way of plug-in type electrical connectors 35A and 35B, as shown. Photodiodes 20A and 20B of shopping cart detection circuit 9 are preferably mounted on an external end portion of housing 31, as shown, adjacent signal focusing means 8A. Alternatively, however, these photodiodes may be mounted on the interiorly of housing 31, and focusing means 8A can be used to focus ambient light onto these photodiodes, as in a single lens reflex camera.

In a simpler, less expensive version of the present invention, shopping cart detection means 9 may be omitted altogether and the message played endlessly. In such an embodiment, the length of the advertiser's message will be selected so that a full repeat of the message will occur during the time normally spent by a shopping cart within transmission zone $Z_i$.

Figure 2A:
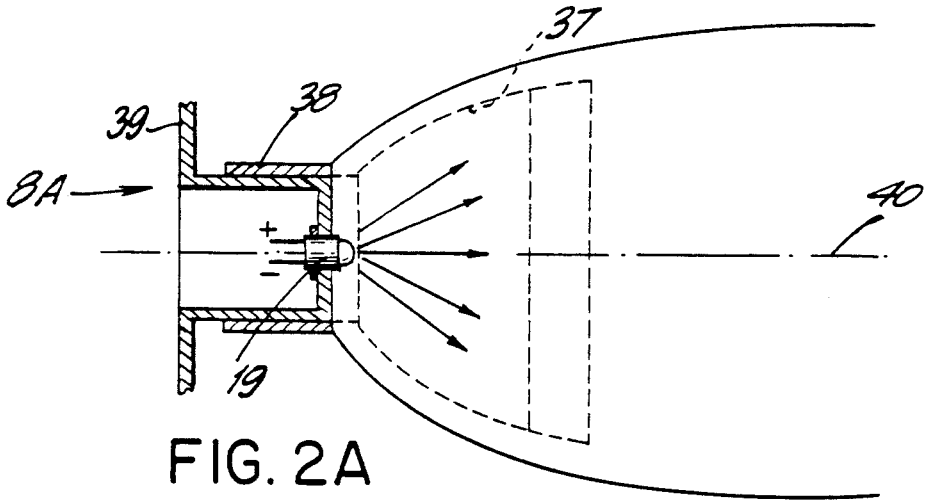
FIG. 2A is a schematic diagram illustrating the signal focusing device of the present invention, removed from the local transmitter of FIG. 2.

In FIG. 2A, reflector-type signal focusing means 8A is illustrated, in which IR photo diode 19 is disposed along the optical axis of an essentially parabolic mirror 37. As the base portion 38 of parabolic mirror 37 is caused to rotate on support 39, the focal point of parabolic mirror 37 is translated along the optical axis 40. When IR photodiode 19 coincides with the focal point of parabolic mirror 37, then the beamwidth of digitally encoded IR pulse signal $\Theta_i$ will be focused, causing transmission zone $Z_i$ to be substantially narrow. However, as photodiode 19 is caused to move relatively along the optical axis towards the open end of parabolic mirror, the beamwidth of the digitally encoded IR pulse signal $\Theta_i$ becomes defocused, causing transmission zone $Z_i$ to substantially widened, as shown. By adjusting the relative position of photodiode 19 along optical axis 40 of parabolic reflector 37, it is thus possible to simply adjust the shape and dimensions that a particular transmission zone $Z_i$ is to occupy within a store aisle. Alternatively, if required or desired, parabolic reflector mirror 37 can be made of overlapping segments so that the focal length thereof can be simply adjusted by the user.

In FIG. 5, the components of shopping cart receiver 3 are illustrated. As shown, each cart receiver 3 comprises signal receiving means 41, signal amplifier means 42 and, transducer means 43. Signal receiving means 41 is provided for receiving transmitted signal $\Theta_i$ over it respective transmission zone $Z_i$, and deriving therefrom an electrical audio message signal $m_1(t)$ representative of the audio message $m_1(t)$ provided from audio storage and playback unit 6. As shown in FIG. 5, cart receiver 3 also comprises power supply means 44 and a photoresponsive power supply enabling means 45 which function in a manner similar to components 10 and 11 incorporated into local transmitter 2 of FIG. 4.

The function of amplifier means 42 is to amplify the derived audio message signal from signal receiving means 41, and to provide this amplified electrical signal to transducer means 43 which converts it into a corresponding analog acoustical signal $A_i(t)$ representative of audio message $m_i(t)$. In order to ensure that cart receiver 3 consumes power only when conditions in the store are suitable for shopping and consumer advertising, power supply enabling means 45 senses and determines whether ambient lighting conditions exceed a predetermined threshold, and if so, provides power $P_R$ from power supply means 44, to the other components 41 and 42 of cart receiver 3. Otherwise, if ambient lighting conditions are sensed as being too low, then each cart receiver 3 is rendered disempowered. While not shown in the drawings for purposes of simplicity and clarity, each cart receiver 3 is provided with an ON/-OFF switch to provide power to power supply enabling means 45, by actuation of the switch to its ON position. As discussed hereinbefore, power supply enabling means 45 can be adapted to collect and store the potential energy of ambient light and thereby maintain the electrical charge of battery 44 when ambient light is high.

As shown in FIG. 5, cart receiver 3 also includes an alarm means 120 and a radio frequency (RF) receiver 121. RF receiver 121 is adapted to receive an RF carrier signal $X_c(t)$ which is broadcasted from a centralized region and extends over a predefined region where shopping carts are permitted. Outside or beyond this predefined "permitted region" typically outside the store, the power of carrier signal $X_C(t)$ drops substantially below a threshold power level. Carrier signal $X_c(t)$ is provided to alarm means 120, which includes a howler-type oscillator circuit that is capable of producing a high output audible tone which is provided to the input of signal amplifier 42. As shown, power supply enabling means 45 provides power to both RF receiver 121 and alarm means 120, in a manner described above. Alarm means 120 is normally biased so that the howler oscillator circuit is switched off when the carrier signal $X_c(t)$ is presented to alarm means 120 with a power above the predetermined threshold level. Thus, when the power of the carrier signal presented at the alarm means input, falls below the predetermined threshold, the howler oscillator circuit is activated, a high out audible signal is provided to amplifier means 42 and a loud howl signal is produced from speaker 43, indicative that the shopping cart is moved outside of the permitted region.

In order to provide general store-wide messages to each shopping cart receiver, audio information $X_s(t)$ can be modulated onto carrier $X_C(t)$. In turn, this audio modulated carrier can be demodulated at RF receiver 121, amplified by amplifier 42 and transduced through speaker 43 to produce audible global messages to all carts.

As illustrated in FIG. 5A, signal receiving means 41 of cart receiver comprises focusing lens 46, current-to-voltage amplifier 48, quantizer 49, decoder 50 and, low pass filter amplifier 51. As shown, digitally encoded IR signal $\Theta_i$ transmitted within transmission zone $Z_i$, is focused onto photodiode 47 through focusing lens 46. The current pulses produced by photodiode 47 are converted into corresponding voltage pulses by current-to-voltage amplifier 48, which are then provided to quantizer 49. Quantizer 49 then separates the transmitted PCM signal from noise which has been added during transmission along the transmission zone or channel $Z_i$. Separation of the binary PCM signal from the noise is achieved by a process of quantization. In accordance with the quantization process, for each pulse interval, quantizer 49 has only to make the relatively simple decision of whether a pulse has or has not been received, that is, which of the two voltage levels (i.e., high or low) has occurred. Then, within each pulse slot, receiver quantizer 49 makes a decision about whether a positive pulse or a negative pulse was received, and then transmits its decision to decoder 50 in the form of a reconstituted output electrical signal. This reconstituted signal is then decoded by decoder 50 to produce a quantized PAM signal, which is filtered by low pass filter 51 to produce $m_1(t)$. This analog signal is amplified by amplifier 42 and then converted into a corresponding acoustical signal $A_i(t)$ by electro-acoustic transducer 43.

Figure 3A:
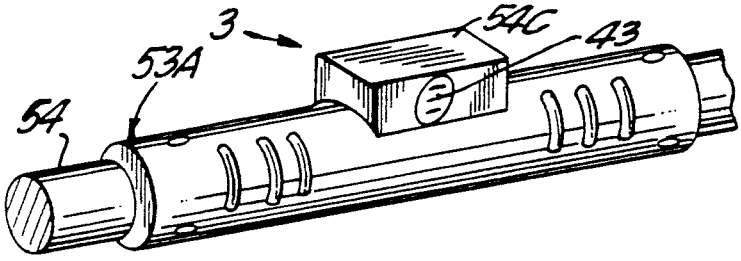
FIG. 3A is a perspective view of the handle bar portion of the cart receiver of the first embodiment shown in FIG. 1D.
Figure 3B:
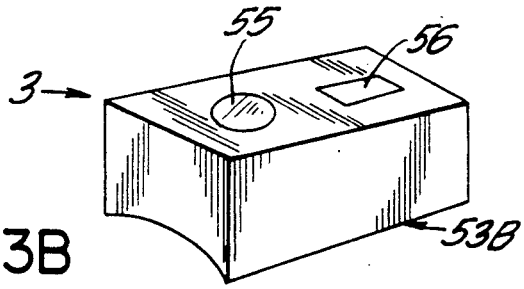
FIG. 3B is a perspective view of the base portion of the cart receiver shown in FIG. 1D.

In FIGS. 3A and 3B, there is shown one embodiment of shopping cart receiver 3 constructed in accordance with the system illustrated in FIGS. 5 and 5A, described above. In this particular embodiment, shopping cart receiver 3 comprises a handle bar housing 53A and a base housing 53B. Housing 53A encloses transducer 43, whereas housing 53B encloses all other system components shown in FIG. 5. In particular, housing 53A is adapted for attachment about a shopping cart handle bar 54, as illustrated in FIG. 3A. Preferably, housing 53A comprises two halves each of which have a semi-cylindrical cavity for enveloping a portion of the handle bar 54. Extending from one half, is a centrally disposed box-like structure 54C which encloses the transducer 43 of cart receiver 3. Transducer 43 is mounted in housing 54C so that audio signal A(t) can pass through housing 54C and be heard by a shopper pushing a shopping cart by handle 54. As shown in FIG. 3B, focusing lens 55 of system 3 is mounted external to housing 53C so as to be capable of gathering the digitally encoded IR pulse signal $\Theta_i$ transmitted from local transmitter 2 when shopping cart detection means 9 detects the a shopping cart moved into transmission zone $Z_i$. Also, photosensor 56 is also externally mounted so as to sense whether ambient lighting conditions are sufficient to activate power supply enabling means 45 of FIG. 5.

Figure 6:
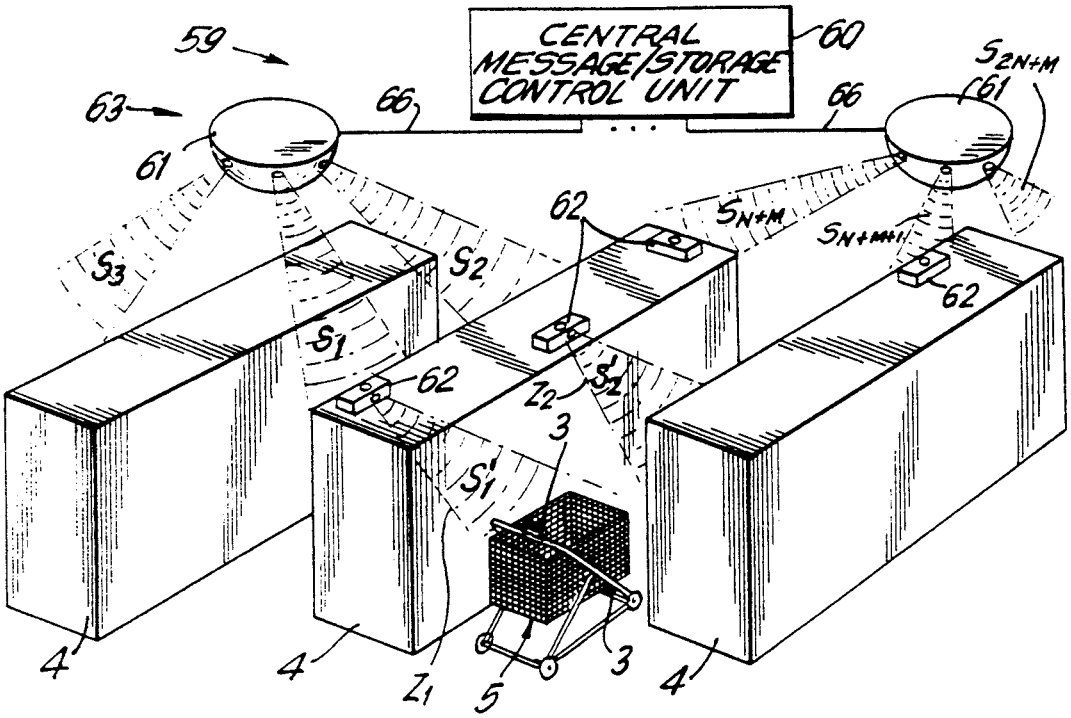
FIG. 6 is a schematic diagram illustrating the operation of the advertising system of the second embodiment of the present invention.

Referring now to FIG. 6, a second alternative embodiment of the advertising system 59 of the present invention is schematically illustrated.

As shown in FIG. 6, instead of providing each local transmitter with its own separate audio message storage and playback means as in the first embodiment described above, audio message $m_i(t)$ of each advertiser is centrally stored in central message storage/control unit 60. Audio messages of groups of local advertisers who have seen assigned respective transmission zones $Z_1$ through $Z_N$, are simultaneously transmitted to a respective remote transmitter unit 61. These remote transmitter units 61, each transmit a plurality of message signals $m_i(t)$ through $m_{i+N}(t)$ to respective local transceivers 62, as shown. Each local transceiver 62, in turn, generates and forms a local transmission zone $Z_i$, in a manner similar to the first embodiment of the present invention described above. Then, when a shopping cart carrying cart receiver 3 is present in transmission zone $Z_i$, cart receiver 3 detects the digitally encoded IR pulse signal, decodes the audio message signal, and produces an audible acoustical output signal corresponding to the audio message which the shopper in the zone can hear. Advantageously, with this embodiment of the present invention, the construction of each local transceiver 62 is greatly simplified as it is relegated to carry out the function of a message signal relay device and transmission zone generator, and not an audio message storage device, as in the first embodiment.

Figure 10:
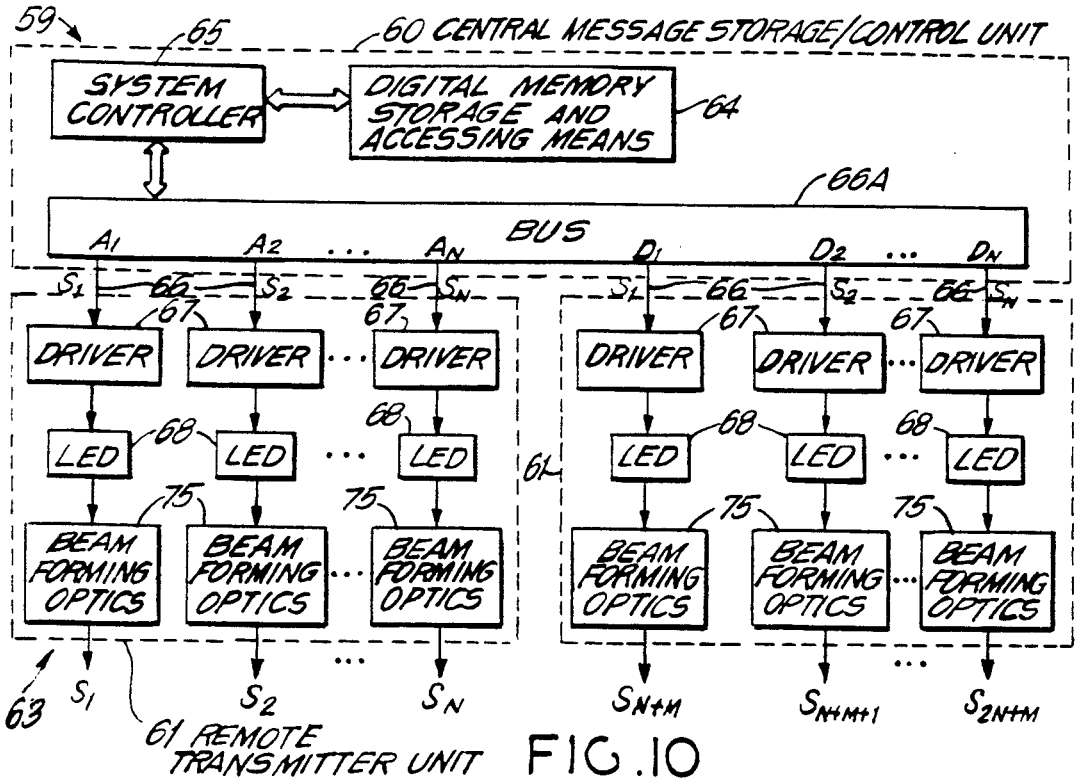
FIG. 10 is a block functional diagram of the central message storage/control unit and plurality of remote transmitter units of the system of the second embodiment of the advertising system of the present invention.

In FIG. 10, the general system architecture of the remote transmitting portion of advertising system 59 is schematically illustrated. As shown, remote transmitter system 63 comprises central message storage/control unit 60 and "active-type" remote transmitters 61. Central message storage/control unit 60 comprises digital memory storage and accessing means 64, system controller 65 and data bus 66A. Digital memory and storage means 64 may be any conventional digital audio or voice storage system realized using, for example, a computer system provided with appropriate voice processing software and input/output interfaces. Notably, voice processing software can sample and digitally encode analog advertising audio messages $m_i(t)$ to provide corresponding digitally encoded PAM pulse signals, which are subsequently stored in memory. System controller 65, on the other hand, can be realized as a microprocessor programmed to provide controlled transport of digitized audio data from digital audio/voice storage system 64, over bus 66A, to a designated set of channels each assigned to a particular remote transmitter, as shown. System controller 65 and data bus 66A can be realized on an output board interfaced with computer system 64 in a manner known in the art. Multi-wire signal cables 66 can be used to pass each set of data channels (e.g., $A_1$ through $A_N$) to remote transmitter 61. Alternatively, each set of signals to be sent to remote transmitter 61, can be multiplexed by a conventional time or frequency division technique, and demultiplexed at remote transmitter 61 to isolate the separate digital encoded signals for transmission to each respective local transceiver 61 assigned to the remote transmitter.

As shown in FIG. 10, the digitally encoded PAM signal transmitted over each conductor of cable 66, is provided to the input of a separate channel of remote transmitter 61. Since input signals $S_1$, $S_2$ . . . $S_n$ have already been digitally encoded in computer system 64, each channel of "active" remote transmitter 61 simply comprises a driver circuit 67 and a light emitting diode 68 which is driven by the driver circuit 67 to produce digitally encoded IR pulse signals $\Theta_1$, $\Theta_2$ . . . $\Theta_n$. Each optical pulse signal emanating from a particular channel of a remote transmitter 61, is then focused through beam forming optics 75, and directed to a respective local transceiver 62.

Figure 7:
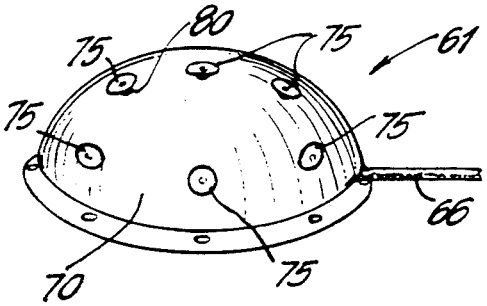
FIG. 7 is a remote transmitter unit of the system of the second embodiment of the present invention.

Preferably, the plurality of driver circuits 67 are realized on a driver circuit board in a conventional manner and are interfaced with each signal cable 66. On the other hand, each LED 68 is preferably mounted through a hole in semi-spherical support base 70, shown in FIG. 7, which can be simply attached to a ceiling runner used in conventional hanging ceilings. Driver circuit board (not shown) can also be mounted within support base 70, and signal cable 66 can be passed above the ceiling from support base 70, to bus 66A of the central message storage/control console 60, as illustrated generally in FIGS. 6 and 10.

Figure 9:
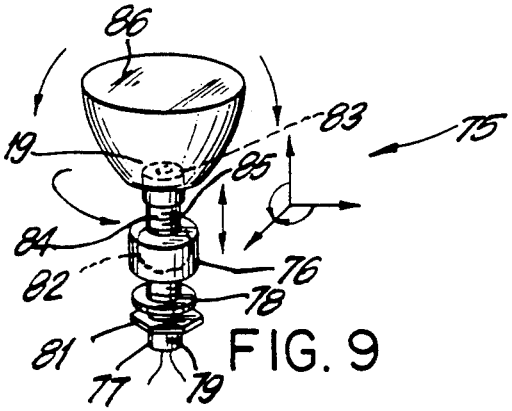
FIG. 9 is an adjustable signal focusing and directing above for use with the local transmitter or local transceiver of the present invention.

In order to focus and direct each digitally encoded PCM pulse signal to its designated local transceiver 62, adjustable beam forming and focusing device 75 shown in FIG. 9 can be used. As illustrated in FIG. 9, each beam forming and focusing device 75 has a socket portion 76 having a shaft 77 bearing a flange 78 and external threads 79. Each shaft 77 is mounted through a hole 80 in semi-spherical support base 70. A nut 81 is threaded on threads 79, behind support base 70, to secure the socket portion 76 to support base 70. A ball portion 82 having a mounting recess 83 for receiving an IR LED 19 is received therewithin as shown in FIG. 9, and permits the optical axis of each mounted LED to be selectively directed in a variety of directions along which a local transceiver 62 may be installed for promotion of a particular product. Projecting from ball portion 82 is stem 84 having exterior threads 85 over which a parabolic mirror 86 is screwed on. As mirror 86 is threaded down onto stem 84, the focal point of the reflective surface of the mirror moves down below LED 19, yet along the optical axis thereof, to cause the projected IR pulse beam from mirror 86 to widen the beam width of the signal being relayed to the designated local transceiver 62. Preferably, the beam is focused narrowly to the designated local transmitter in order to maximize signal energy received thereby.

Figure 11:
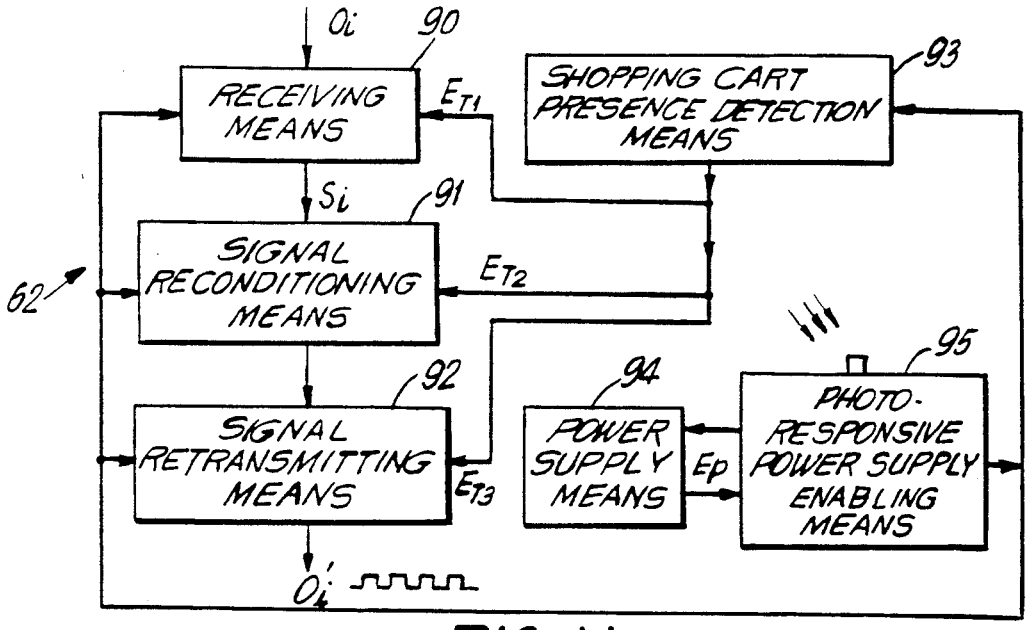
FIG. 11 is a block functional diagram of a local transceiver of the system of second embodiment of the present invention.

As illustrated in FIG. 11, each local transceiver 62 of the second embodiment comprises a signal receiving means 90, signal reconditioning means 91, signal retransmitting means 92, a shopping cart detection means 93, power supply means 94 and photo-responsive power supply enabling means 95.

Figure 11A:
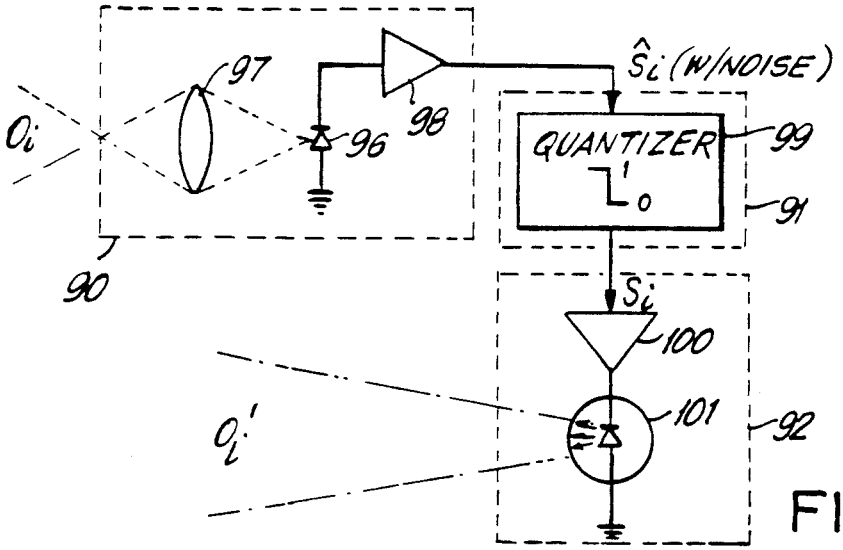
FIG. 11A is a block functional diagram of the preferred embodiment of the local transceiver illustrated in FIG. 11.

As illustrated in FIG. 11A, signal receiving means 90 of the illustrated embodiment comprises a photo-diode 96 which is used to detect transmitted signal $\Theta_i$ that has been focused by focusing lens 97. The output of photodiode 96 is provided as input to a current-to-voltage amplifier 98 which produces output signal $\Theta_i$ comprising the originally transmitted digitally encoded PAM pulse signal with noise. This corrupted signal $\Theta_i$ is then reconditioned by signal reconditioning means 91 which, as shown in FIG. 11A, is preferably realized by a two-level quantizer 99. Similar to quantizer 49 in local transmitter 2 of the first embodiment, quantizer 99 determines whether a positive pulse or a negative pulse has been received during each pulse slot, and transmits its decisions in the form of a reconstituted or regenerated pulse train, to the signal retransmitting means 92. As illustrated in FIG. 11A, signal retransmitting means 92 preferably comprises a driver circuit 100 which drives infra-red LED 101 so as to produce a digitally encoded PAM IR pulse signal $\Theta_i$ that corresponds to reconstituted PAM pulse signal $S_i$. IR pulse signal $\Theta_i$ is focused and directed over a transmission zone $Z_i$, using focusing device 75 illustrated in FIG. 9 and described above. Reception and decoding of IR pulse signal $\Theta_i$ can be achieved using cart receiver 3, described in connection with the first embodiment.

As illustrated in FIG. 11, local transceiver 62 of the second embodiment also includes shopping cart detection means 93, power supply means 94 and photo-responsive power supply enabling means 95, configured in a manner similar to that shown in local transmitter 2 of the first embodiment. As such, power supply means 94 will only provide power to the other components of local transceiver receiver upon the ambient light conditions being sufficient to activate power supply enabling means 95. Once activated, power is supplied components 90, 91, 92, and 93. Then, when cart detection means 93 detects a cart in transmission zone $Z_i$, signal receiving means 90, signal reconditioning means 91 and signal retransmitting means 92 will each be enabled and rendered operative upon provision of enabling signals $E_{71}$, $E_{72}$ and $E_{73}$, respectively, to these components. In an alternative embodiment, cart detection means 93 may be eliminated altogether and components 90, 91 and 92 operated continuously.

Figure 8:
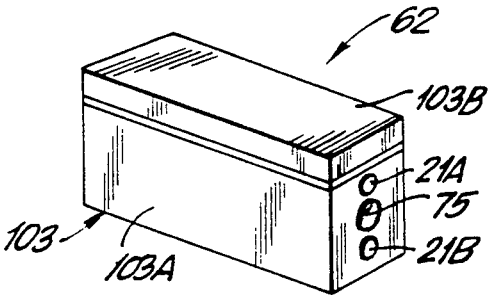
FIG. 8 is a perspective view of a local transceiver in accordance with a second embodiment of the present invention.

In FIG. 8, a housing 103 for active-type local transceiver 62 is shown, comprising a first portion 103A for enclosing circuitry for carrying out the functions represented in FIGS. 11 and 11A, except for power supply means 94. The later component 94, preferably a rechargeable battery pack, is contained within module 103B which is operably associated with housing 103A and its circuitry in a manner similar to that described in local transmitter 2 of the first embodiment.

Figure 10A:
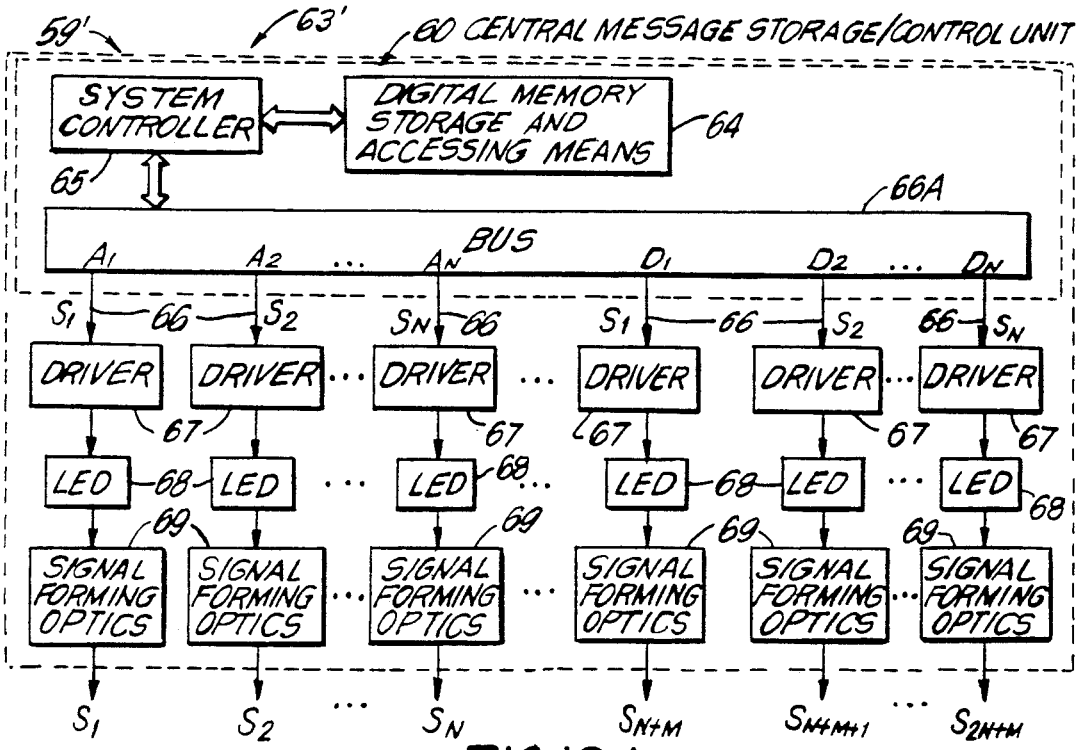
FIG. 10A is a block functional diagram of the remote transmitter system of yet a third embodiment of the advertising system of the present invention.
Figure 10B:
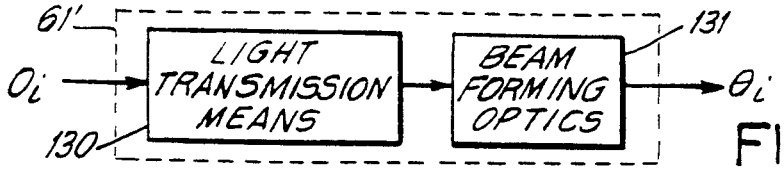
FIG. 10B is a block functional diagram of the passive remote transmitter of the advertising system of the third embodiment.

In yet an alternative configuration, shown in FIG. 10A, advertising system 59' includes message storage/control console 60, drivers 67, LEDs 68 and optical signal forming optics 69 of remote transmitter 62. In such an alternative embodiment, remote transmitter 61' is realized as a "passive-type" device comprising a light transmission means 130 and optical beam forming optics 131 as shown in FIG. 10B. Preferably, light transmission means 130 comprises a fiber optic cable, or some other form of light pipe, which interfaces with optical signal forming optics 69, on the one hand, and with beam forming optics 131, on the other. Preferably, beam forming optics 131 is realized as an optical system which conducts optical signal $\Theta_i$ from light pipe 130 and propagates a beam $\Theta_i$ of a desired shape and dimensions to a designated local transceiver 62'.

Figure 11B:
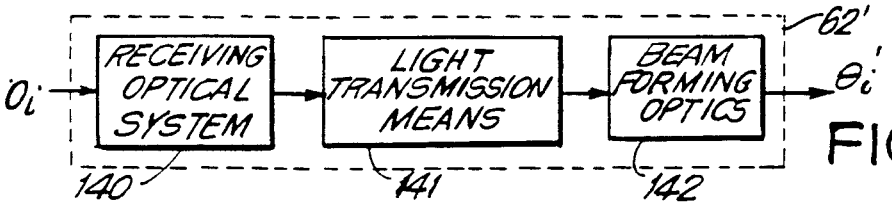
FIG. 11B is a block functional diagram of passive local transceiver of the advertising system of the third embodiment.

In the alternative advertising system 59' described above, each local transceiver 62' is preferably be formed as an entirely passive device. For example, as shown in FIG. 11B, each local transceiver 62' comprises an optical signal receiving means 140, a light transmission means 141 and optical beam forming optics 142. Preferably, optical signal receiving means 140 is realized as an optical system which gathers the light of transmitted optical beam $\Theta_i$ and channels such light through light transmission means 141, which preferably is a fiber optic cable or other form of light conducting pipe. The light signal $\Theta_i$ conducted through the light pipe 141 is then formed into a beam $\Theta_i$ of desired shape and dimensions, which is then directed over a respective advertising zone $Z_i$, as discussed hereinabove.

The additional optical power required by the above-described passive system components 61' and 62' can be provided by drivers 67 of central message storage/control console 60. Typically, these drivers will be driven by electrical power supplied from a conventional power supply line. Advantageously, with this embodiment of the present invention, all portable system components 61' and 62' are completely passive and thus do not require battery storage devices and the like, thereby increasing the flexibility of advertising system.

Figure 12:
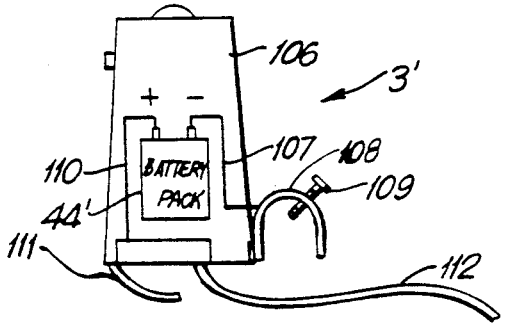
FIG. 12 is an elevated side view of a second embodiment of the cart receiver of the present invention.
Figure 12A:
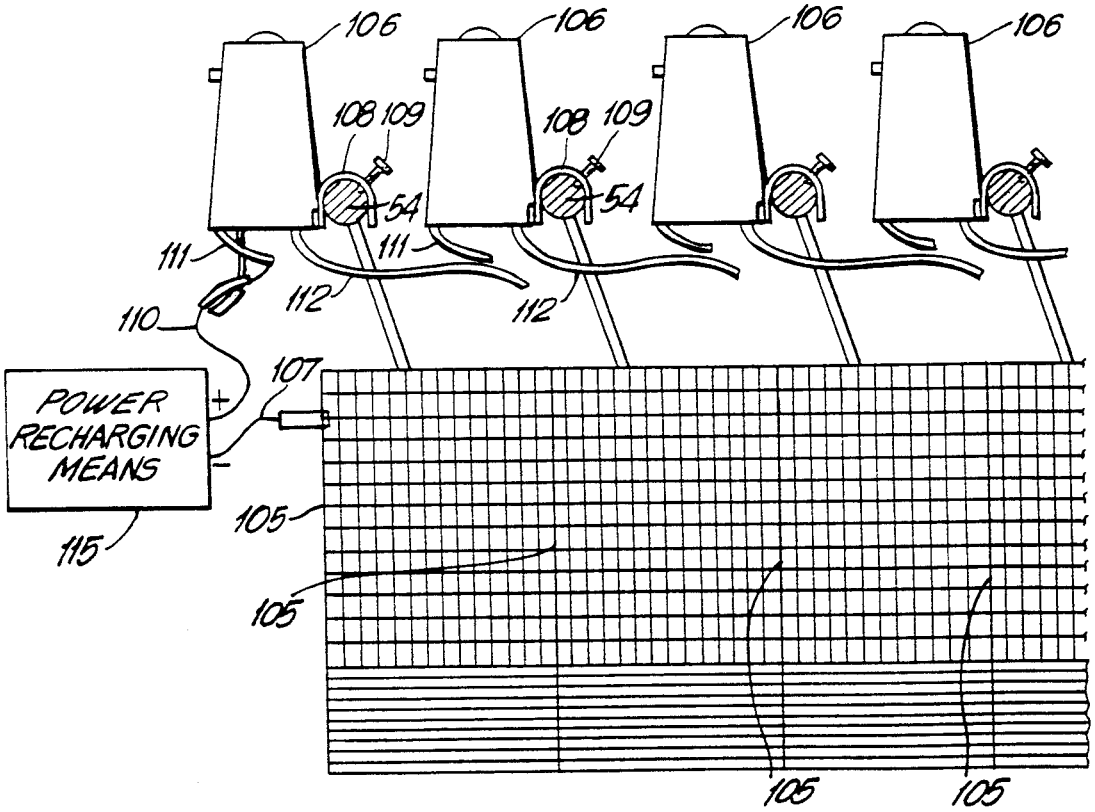
FIG. 12A is an elevated side view of a plurality of a shopping cart nested together in a conventional manner with each cart receiver connected in parallel configuration to a power recharging device.

In FIG. 12, a second embodiment of the cart receiver of the present invention is shown. Each cart receiver 3' is especially adapted for permitting recharging of respective battery power supplies, while a plurality of electrically conductive shopping carts 105 are nested together, as illustrated in FIG. 12A.

Cart receiver 3' of FIG. 12 is similar to cart receiver 3 shown in FIG. 3, in that housing 106 contains essentially all of the circuitry illustrated in FIG. 5. In cart receiver 3', power supply means 44' would be a rechargeable battery pack whose negative terminal 107 is connected to an electrically conductive housing mounting device 108, having, for example, a screw 109 which can be secured against the metallic handle bar 54 of the conductive cage-like shopping cart 105. Positive terminal 110 of rechargeable battery pack 44' is electrically connected to first and second conductive elements 111 and 112, which, as shown are spaced apart and disposed at least partially external to the cart receiver housing 106. The second conductive element 112 has a length such that when shopping carts 105 are nested together, the second conductive element 112 of one cart receiver establishes electrical contact with the first conductive contact 111 of an adjacent nested cart receiver, as shown. The negative terminal of each cart receiver is grounded by way of screws 109 contacting the metallic cage 105, which are all at the same potential. When the carts are nested together and cart receivers electrically interconnected in parallel configuration, as shown in FIG. 12A, a conventional battery recharging device 115 can be connected to the positive and negative terminals 110, 107 of a cart receiver in order to simultaneously recharge the plurality of power storage modules 44' contained in the cart receivers.

While the particular embodiments shown and described above have proven to be useful in many applications in the advertising art, further modifications of the present invention herein disclosed will occur to persons skilled in the art to which the present invention pertains, and all such modifications are deemed to be within the scope and spirit of the present invention defined by the appended claims.

What is claimed is:

1. A system for delivering audible advertising messages to shopping carts in a store as said shopping carts are moved through a plurality of spatially defined transmission zones arranged in the aisles of said store, said system comprising:

(A) a plurality of local transmitters, each being selectively placed in said store and including (1) a transmitter housing having a compact construction and capable of being attached to and detached from a selected support structure in said store, (2) audio message storage and playback means disposed in said transmitter housing for storing and playing back at least one stored audio message, and (3) transmitting means disposed in said transmitter housing for transmitting over one said spatially defined transmission zone, a modulated carrier signal formed by modulating a carrier signal by said audio message provided from said audio storage and playback means, said spatially defined transmission zone having a selected geometry and predetermined dimensions so as to occupy an assigned region of space within one said store aisle, said transmitting means further including means for focusing said modulated carrier signal so as to provide said spatially defined transmission zone of selected geometry and predetermined dimensions; and (B) a plurality of cart receivers, each said cart receiver being mounted to one said shopping cart and including (1) a cart receiver housing having a compact construction and means for mounting said cart receiver housing to one said shopping cart, (2) receiving means disposed in said cart receiver housing, for receiving over one said spatially defined transmission zone, said modulated carrier signal and deriving therefrom an electrical audio signal representative of said audio message, and (3) transducer means operably associated with said receiving means for transducing said electrical audio signal into an audible acoustical signal that is representative of said audio message.

2. The system of claim 1, wherein said transmitting means further includes shopping cart detection means disposed in said transmitter housing, for enabling the transmission of said modulated carrier signal over said spatially defined transmission zone, upon the detection of said shopping cart in each said spatially defined transmission zone.

3. The system of claim 2, wherein each said local transmitter further comprises a local transmitter battery power supply means physically associated with said transmitter housing, for providing power to said audio message storage and playback means and said transmitting means, and wherein each said cart receiver further comprises a cart receiver battery supply means physically associated with said cart receiver housing, for providing power to said receiving means.

4. The system of claim 3, wherein said modulated carrier signal is an modulated optical carrier signal, and wherein said transmitting means comprises means for modulating an optical carrier signal said stored audio message to produce said modulated optical carrier signal and means for transmitting said modulated optical carrier signal over said spatially defined transmission zone, and wherein each said receiving means comprises means for receiving said modulated optical carrier signal and deriving therefrom said audio message signal representative of said audio message.

5. The system claim 4 wherein said modulated optical carrier signal has a wavelength within the infra-red frequency band.

6. The system of claim 5, wherein said audio storage and playback means comprises means for playing back a prerecorded cassette tape carrying said audio message is recorded.

7. The system of claim 3, wherein said local transmitter battery power supply means comprises a replaceable power module selectively connectable to and disconnectable from said transmitter housing.

8. The system of claim 1, wherein said shopping carts are electrically conductive and wherein each said cart receiver further comprises:

a rechargeable power storage means disposed in said cart receiver housing and further including a positive and a negative terminal;

a first conductive element electrically connected to said positive terminal;

a second conductive element electrically connected to said positive terminal and having a length such that when two or more electrically conductive shopping carts are nested together, said second conductive element of one said cart receiver establishes electrical contract with said first conductive element of said adjacent cart receiver; and electrical grounding means connecting said negative terminal of said rechargeable power storage means to said electrically conductive shopping cart, so that each said negative terminal of each said cart receiver is maintained at the same electrical potential when said two or more electrically conductive shopping carts are nested together, thereby permitting simultaneous recharging of each said rechargeable power storage means.

9. The system of claim 1, which further comprises global receiving means of receiving globally broadcasted message signals from a centralized source and transducing said globally broadcast message signals to produce audible global messages.

10. The system of claim 8, which further comprises power recharging means for simultaneously recharging said rechargeable power storage means, said power recharging means being capable of establishing an electrical connection between at least one said first conductive element and at least one said negative terminal, so that each said rechargeable power storage means is connected in an electrically parallel configuration with said power recharging means.

11. A system for delivering audible advertising messages to shopping carts in a store as said shopping carts are moved through a plurality of spatially defined transmission zones arranged in the aisles of said store, said system comprising:

(A) a plurality of local transmitters, each being selectively placed in said store and, including (1) a transmitter housing having a compact constructions and capable of being attached to said detached from a selected support structure in said store, (2) audio message storage and playback means disposed in said transmitter housing for storing and playing back at least one stored audio message, and (3) transmitting means disposed in said transmitter housing for transmitting over one said spatially defined transmission zone, a modulated carrier signal formed by modulating a carrier signal by said audio message provided from said audio storage and playback means, said spatially defined transmission zone having a selected geometry and predetermined dimensions so as to occupy an assigned region of space within one said store aisle;

(B) a plurality of cart receivers, each said cart receiver being mounted to one said shopping cart and including (1) a cart receiver housing having a compact construction and means for mounting to one said shopping cart, (2) receiving means disposed in said cart receiver housing, for receiving over one said spatially defined transmission zone, said modulated carrier signal and deriving therefrom an electrical audio signal representative of said audio message, and (3) transducer means operably associated with said receiving means for transducing said electrical audio signal into an audible acoustical signal that is representative of said audio message storage; and (C) alarm means for producing an audible tone when said shopping cart is moved outside of a predefined permitted region.

* * * * *